United States Patent [19]

Norigoe et al.

[11] Patent Number: 4,597,680

[45] Date of Patent: Jul. 1, 1986

[54] DOT PRINTER HEAD WITH ALTERNATE MAGNETIC FLUX PATHS

[75] Inventors: Takashi Norigoe; Kuniaki Ochiai, both of Shizuoka, Japan

[73] Assignee: Tokyo Electric Co., Ltd., Tokyo, Japan

[21] Appl. No.: 654,022

[22] Filed: Sep. 25, 1984

[30] Foreign Application Priority Data

Sep. 26, 1983 [JP] Japan ..... 58-177266

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS 4,453,840 6/1984 Hodne ..... 400/124

FOREIGN PATENT DOCUMENTS 57-83464 5/1982 Japan ..... 400/124

58-96568 6/1983 Japan ..... 400/124

*Primary Examiner*—Edgar S. Burr

*Assistant Examiner*—David A. Wiecking

*Attorney, Agent, or Firm*—Oblon, Fisher, Spivak, McClelland & Maier

[57] ABSTRACT

The printhead is constructed such that opposed surfaces of armatures are formed between the armatures adjacent to each other with small gap being left therebetween and cores opposed to each of the armatures are provided with alternative opposed magnetic fluxes. The armatures are supported in such a way that the guide holes formed in the middle of each armature are engaged with the fixed armature guides without interfering with their side surfaces, and thereby side magnetic paths of sufficient cross sectional area can be formed, and further their equivalent mass can be decreased and a high speed printing is enabled, and the armatures can be moved smoothly.

2 Claims, 10 Drawing Figures

*COMMONLY ASSIGNED*

DOT PRINTER HEAD WITH ALTERNATE MAGNETIC FLUX PATHS

FIELD OF THE INVENTION

This invention relates to a dot printer head in which armatures to which needles are connected are operated under an exciting action of coils so as to print dots and thereby to print characters and figures with collected dots.

OBJECT OF THE INVENTION

It is an object of the present invention to provide side magnetic paths having sufficient large cross sectional area.

It is another object of the present invention to enable a high speed printing by decreasing equivalent mass of armatures.

It is yet further object of the present invention to make a smooth movement of armatures.

Other objects of the present invention will become apparent from the following description.

TECHNICAL BACKGROUND AND PROBLEMS OF THE INVENTION

Figure 1:
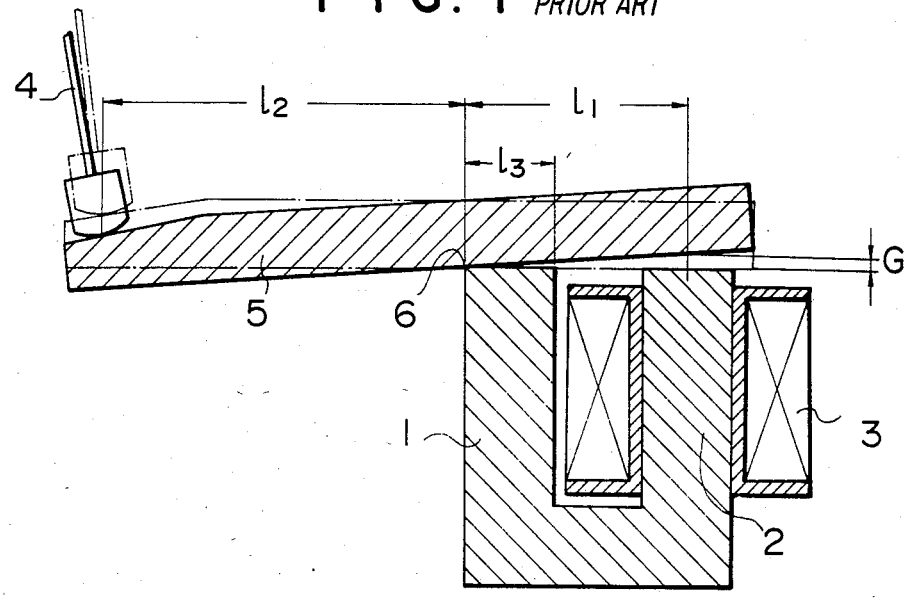
FIG. 1 PRIOR ART
FIG. 1 is a partial lateral cross sectional view for showing one example of the conventional system and illustrating a relation among armatures, cores and yokes.

A dot printer head is operated such that armatures are operated under an energization of coils. Needles are struck against a platen under the action of armatures so as to perform a printing operation. Structure for driving armatures is constructed in general as shown in FIGS. 1 and 2.

That is, coils (3) are installed in each of a plurality of cores (2) integrally formed with yokes (1) and armatures (5) for causing needles (4) to be struck against the platen under an energization of the coils (3). The armatures 5 are arranged around a fulcrum point (6) in such a way as they may be raised up or down. Both sides of the armatures (5) are formed with recesses (8) to be held by the guides (7). The guides (7) are positioned at the plane opposing to the yokes (1).

A printing operation is performed in such a way as the coils (3) are energized to retract the armatures (5) against the cores (2). During this operation, magnetic flux flows from the cores (2) to the yokes (1) through the armatures (5). In order to perform the printing operation, it is necessary to produce a high retraction force in the cores (2), resulting in a requirement for a large area in opposing surfaces of the armatures (5) and the yokes (1).

Figure 2:
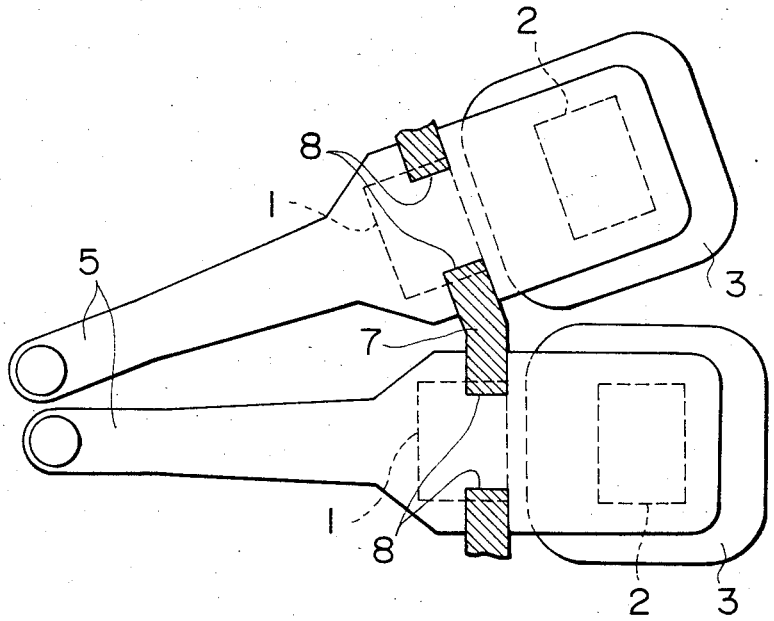
FIG. 2 PRIOR ART
FIG. 2 is a front elevational view partly broken away for showing the prior art.

However, in the case of the system shown in FIGS. 1 and 2, the recesses (8) positioned in the opposing surfaces of the yokes (1) due to a positional relation with the guides (7) must be formed in the armatures (5). Accordingly, if it is required to make a large opposing area of the armatures (5) against the yokes (1), the radial width $1_3$ of the yokes (1) must be increased. Assuming that the distance between the fulcrum point (6) and the center of the core (2) is $l_1$ and that the distance between the fulcrum point (6) and the needle striking extremity end point of the armature (5) is $l_2$, an increased distance $l_2$ causes the distance $l_1$ to be increased, resulting in an increase of the air gap G. Accordingly, a sufficient retracting force may not be obtained in the cores (2). Also, the prior art shown in FIGS. 1 and 2 has the disadvantage that the consumption of electric power is increased when the distance $l_1$ is increased, and, when the lever ratio $l_2 l_1$ is decreased, the equivalent mass of the armatures (5) is increased, resulting in that a high speed printing operation may not be performed.

Figure 3:
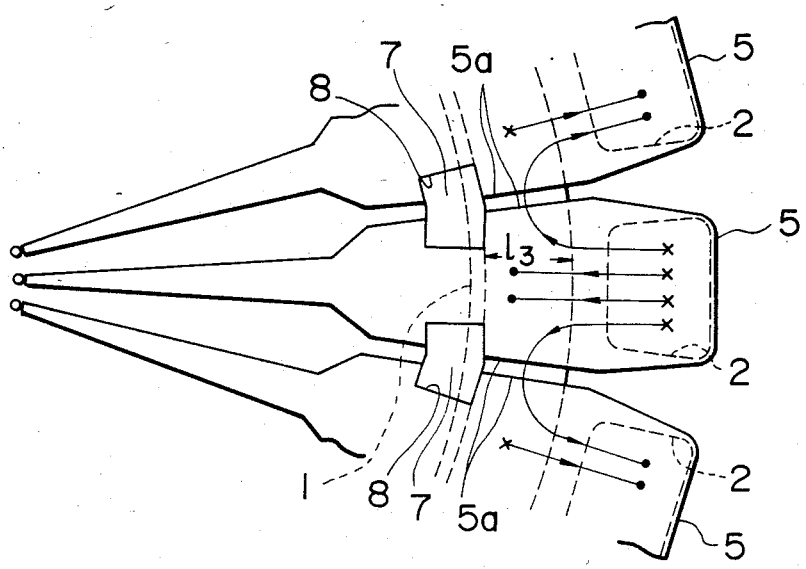
FIG. 3 is a partial top plan view for showing one example of the improvement of the present invention.
Figure 4:
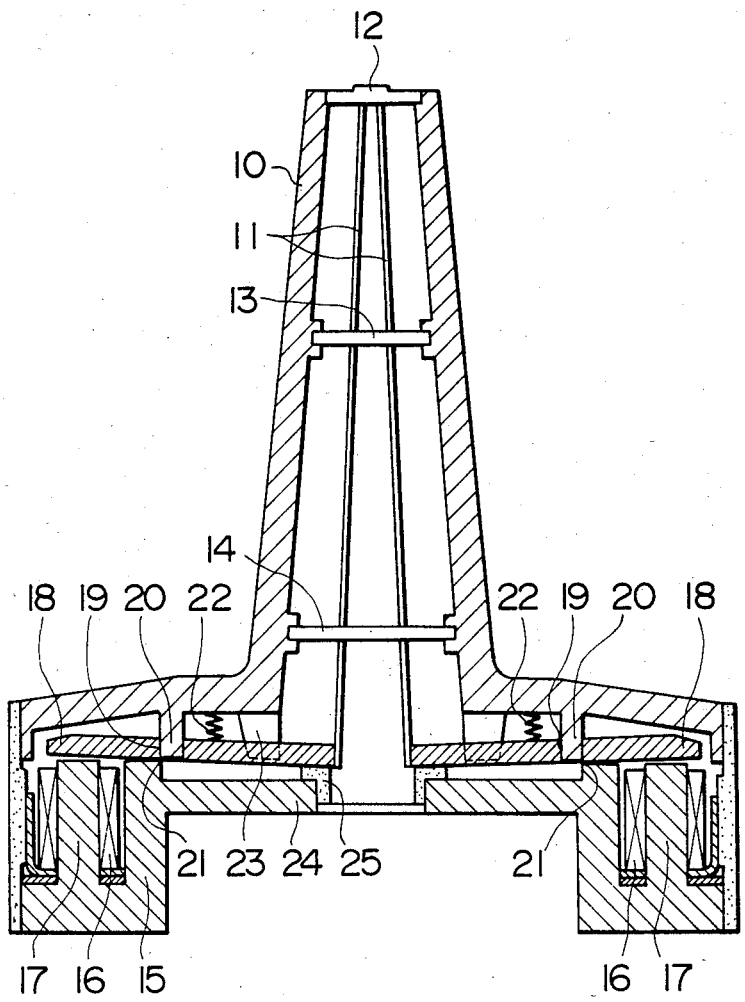
FIG. 4 is a lateral cross sectional view for showing one preferred embodiment of the present invention with its entire structure being reduced in size.
Figure 5:
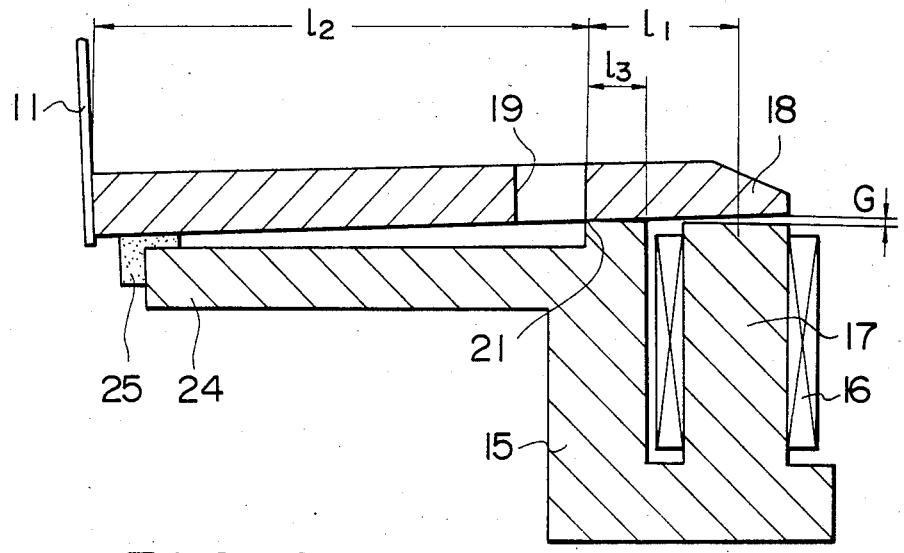
FIG. 5 is a lateral cross sectional view for showing a part of the present invention.
Figure 6:
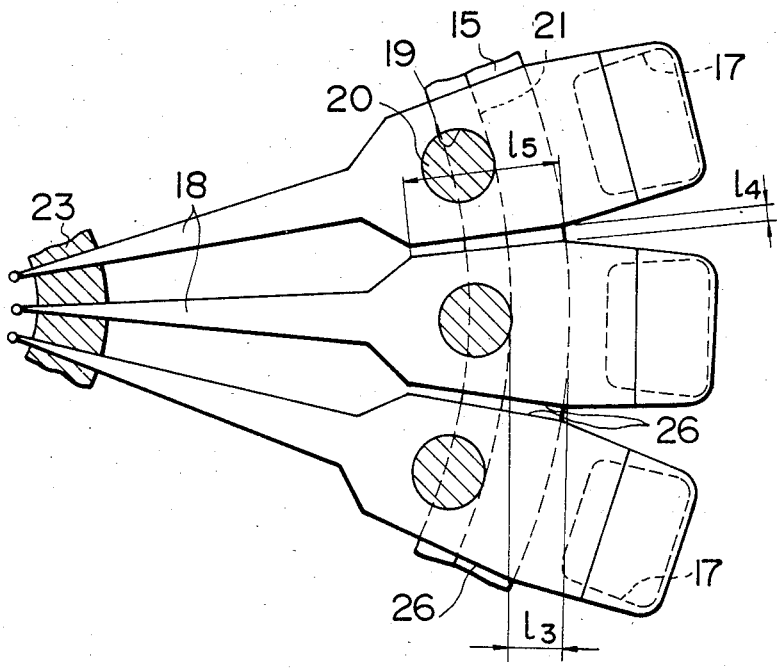
FIG. 6 is a front elevational view partly broken away for showing the present invention.
Figure 7:
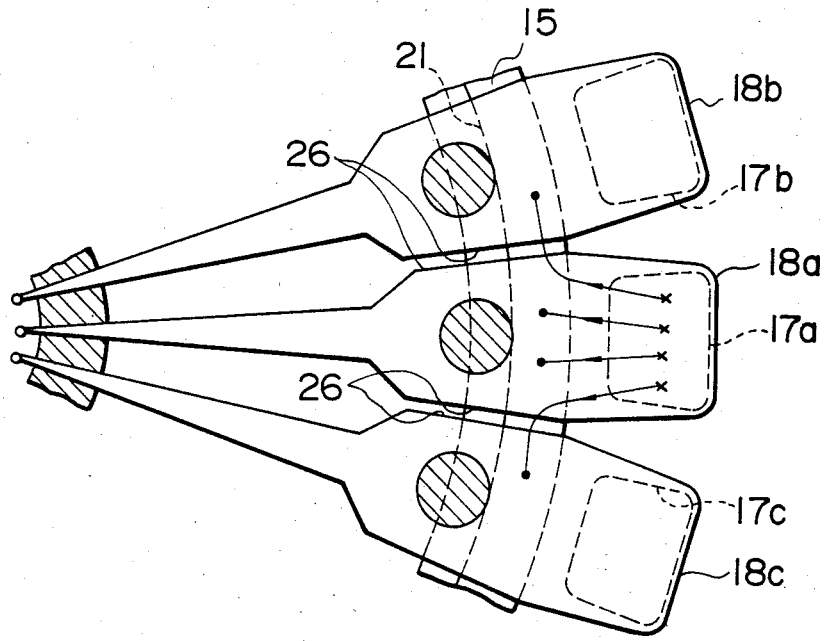
FIG. 7 is an illustrative view in front elevation for showing a flow of magnetic flux when one of the coils is energized.

In view of the above, the invention disclosed in U.S. Ser. No. 556,297 now abandoned and refiled as U.S. Ser. No. 725,505 by the present inventor et al. has been proposed. In this arrangement, as shown in FIG. 3, a plurality of radial cores (2) are arranged in the annular yokes (1). The coils are installed in these cores (2) in such a way that directions of the magnetic fluxes are made alternatively opposite to each other. An armature (5) is connected to each of the needles (4). Each armature (5) is opposed to the corresponding core (2) and arranged in such a way that it may be raised up or down around a fulcrum point (6) of a connection part between the core (2) and the yoke (1). The armature opposing surface 5*a* forms a magnetic path with a small clearance between the yokes (1) and the armatures (5) at each side of armature (5).

With such a structure as above, the magnetic fluxes from the cores (2) flows partially to the yokes (1) through adjoining armatures (5). Accordingly, the opposing area of the armatures (5) in respect to the yokes (1) may be decreased, thereby reducing the distance $l_3$. Along with this reduction, the distance between the fulcrum point (6) and the center of each core (2) can be decreased. Further, the air gap between each core (2) and the corresponding armature (5) can be reduced.

The present invention has improved the above-mentioned prior invention.

PREFERRED EMBODIMENT OF THE INVENTION

The first preferred embodiment of the present invention will be described with reference to FIGS. 3 to 9. Reference numeral (10) designates a guide frame. To the guide frame (10) are fixed needle guides (12), (13) and (14) for use in slidably holding a plurality of needles (11). To the guide frame (10) are screwed annular yokes (15). At the outer parts of the yokes (15) are integrally formed a plurality of radial disposed cores (17) for use in fixing a plurality of radially disposed coils (16). A plurality of armatures (18) oppose corresponding yokes (15). Each armature (18) has a circular guide hole (19) at its central part. A column-like armature guide (20) integrally formed with the guide frame (10) is fitted into each guide hole (19). Each armature (18) is pivotable up or down around a corresponding fulcrum point (21) and each armature (18) is biased in a return direction by an associated spring (22).

The guide holes are located between the needles (11) and the fulcrum points (21). Each guide hole (19) is located so close to the corresponding fulcrum point (21) that a part of the circumference thereof contacts the fulcrum point (21). The guide frame (10) is also formed with ribs (23) for preventing oscillation at both sides of extreme ends of the armatures (18). The yokes (15) have disk parts (24) at their inner circumferences, and armature stoppers (25) are mounted on the disk parts (24).

The radial sides of the armatures (18) have surfaces (26) which are opposed to a corresponding surface of the adjacent armature (18) over a length of $l_5$. The armatures (18) are circumferentially spaced by a small clearance $l_4$.

Figure 9:
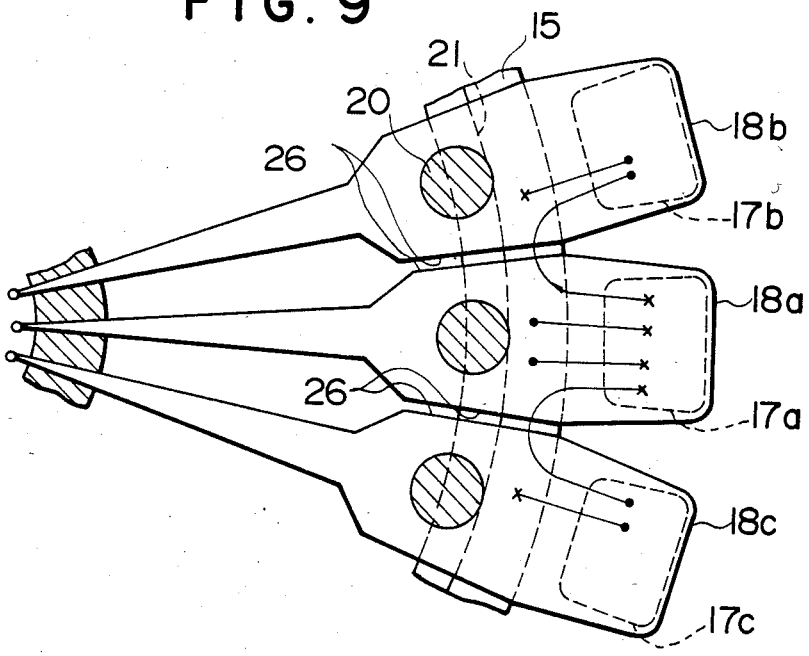
FIG. 9 is an illustrative view in front elevation for showing the flow of magnetic flux when all the coils are energized.
Figure 10:
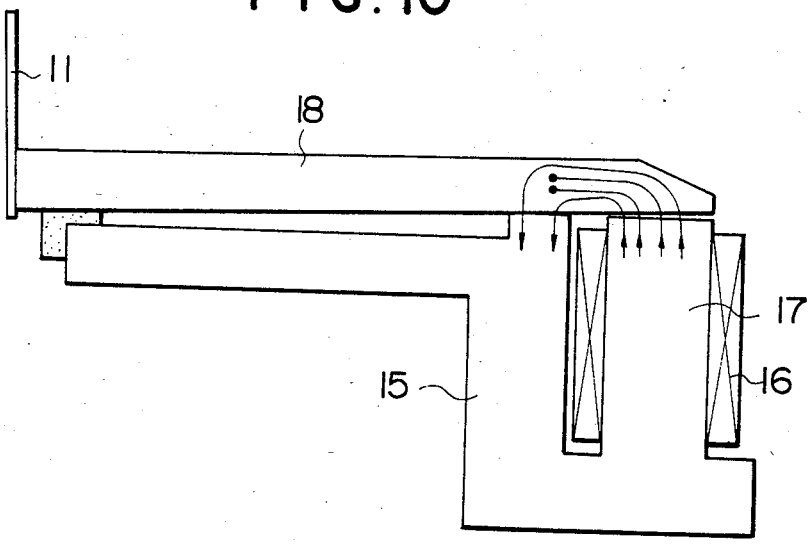
FIG. 10 is an illustrative view in top plan for showing the flow of magnetic flux.

With the arrangement above, when the coils (16) are energized, the armatures (18) are retracted against the cores (17), thereby causing the needles (11) to strike the platen. In FIGS. 9 and 10, when a specified coil (16) is energized, a part of the magnetic fluxes flows to the part of the yokes (15) opposed to the associated armature (18*a*) and the remaining magnetic fluxes flows from the armature (18*a*) to the yokes (15) through adjoining armatures (18*b*) and (18*c*) and return to the original core (17*a*).

Figure 8:
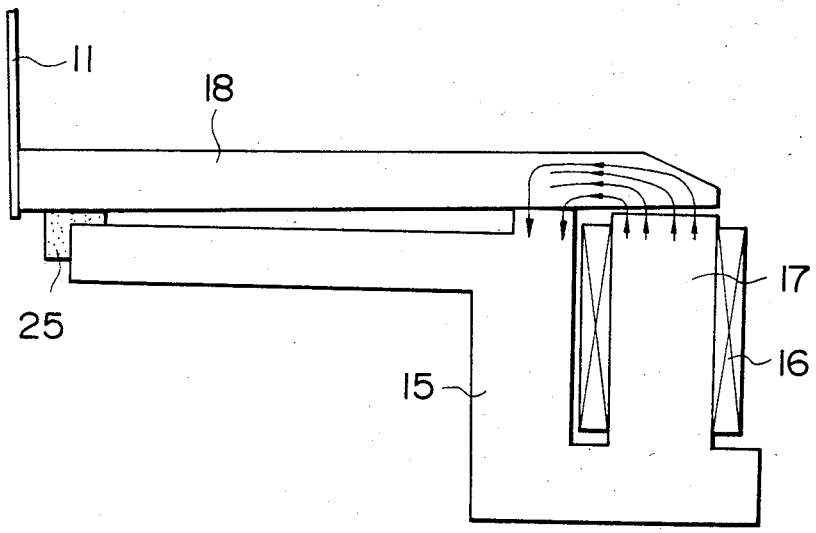
FIG. 8 is an illustrative view in top plan for showing the flow of magnetic flux.

In order to energize the coils (16), the directions of the magnetic fluxes for each of the coils (16) can be changed alternatively as shown in FIG. 8. That is, a part of the magnetic fluxes from the cores (17*a*) flow to the yokes (15) through the armatures (18*a*) and reach the cores (17*a*) and the remaining magnetic fluxes reached from the cores (17*a*) to the armatures (18*a*) flow from the armatures (18*a*) to the adjoining cores (17*b*) and (17*c*) through the adjoining armatures (18*b*) and (18*c*).

In this way, part of the magnetic fluxes flow to the yokes (15) through the adjoining armatures (18) and back to the original cores (17). Accordingly, a sufficient magnetic path may be attained even if the opposed area of the armatures (18) in respect to the yokes (15) is reduced. As a result, in FIG. 4, it is possible to decrease the radial width of the yokes (15) and to reduce the distance $l_3$. Along with this reduction, the distance $l_1$ between the fulcrum points (21) and the center of the cores (17) can be reduced. Additonally, the air gaps G between the cores (17) and the armatures (18) may also be decreased.

Due to this arrangement, a high retraction force can be attained. A short $l_1$ enables the ratio $l_2/l_1$ (the distance $l_2$ being the distance between the fulcrum point (21) and the needles (11)) to be increased, and the equivalent mass of the armatures (18) can be decreased. In particular, since the guide holes (19) which receive to the armature guides (20) are formed at the center of the armatures (18), opposed surfaces of the armatures (18) for forming the side magnetic paths between the adjoining armatures (18) can approach to the fulcrum points (21). Accordingly, the equivalent mass of the armatures (18) can be reduced further, the length of the side magnetic paths is reduced, high speed printing can be obtained, and the consumption of electric power can be reduced.

Further, since the guide holes (19) so close to the fulcrum points (21) that a part of their circumferences contact the fulcrum points (21), the relative movement of the armatures with respect to the armature guides (20) is decreased and sliding frictional resistances between the armatures (18) and the armature guides (21) is quite low. Therefore, it is possible to pivot the armatures (18) smoothly.

With the construction of the present invention, it has some advantages that a part of the magnetic fluxes can flow from the armatures to the yokes through the adjoining armatures when the magnetic fluxes from the cores flow to the yokes through the armatures and back to the original cores. Additionally, the opposed area of the armatures in respect to the yokes can be decreased. Also, the radial width of the yokes can be reduced, and thereby the distance between the fulcrum points of the armatures and the center of the cores can be decreased compared with that between the fulcrum points of the armatures and the extremity ends of the armatures. Therefore, the air gap between the cores and the armatures is reduced, a sufficient retraction force is provided, and at the same time the equivalent mass of the armatures is reduced. In particular, guide holes receiving the armature guides are formed at the central part of the armatures. Thereby, the opposed surfaces of the armatures can be approached to the fulcrum points of the armatures, so that the equivalent mass of the armatures can be decreased further to enable a high speed printing and to reduce consumption of electric power. Further, the guide holes that receive the armature guides are formed in the armatures close to the fulcrum points. Accordingly, relative movement amount between the armature guides and the guide holes and the sliding frictional resistance between both of them are both reduced, and the armatures can be operated in a quite smooth manner.

What is claimed is:

1. A dot printer head comprising:

(a) a guide frame;

(b) an annular yoke mounted on said guide frame;

(c) a plurality of cores arranged radially on said annular yoke;

(d) a plurality of coils, one of said plurality of coils being mounted on each one of said plurality of cores and being installed in such a way that the coils on each side of any given coil have magnetic fluxes the directions of which are opposite to the direction of the magnetic flux in said any given coil;

(e) a plurality of armatures pivotably mounted on said annular yoke, one of said plurality of armatures being operatively associated with each one of said plurality of cores, each one of said plurality of armatures being pivotable about a corresponding fulcrum point on said annular yoke, each one of said plurality of armatures having two radially extending side surfaces extending radially inwardly and radially outwardly of said fulcrum points, the radially extending side surfaces on adjacent ones of said plurality of armatures being separated by a small clearance through which magnetic flux flows during use of the dot printer head, a guide hole being formed in each one of said plurality of armatures, said guide holes being located radially inwardly of said fulcrum points but contacting said fulcrum points;

(f) a plurality of print needles, one of said plurality of print needles being operatively connected to each one of said plurality of armatures; and (g) a plurality of armature guides mounted on said guide frame, each one of said plurality of armature guides being received in a corresponding one of said guide holes in said plurality of armatures.

2. A dot printer head as recited in claim 1 wherein each one of said guide holes is located on the radial center line of the corresponding one of said plurality of armatures and is symmetrical with respect thereto.

* * * * *